US010304435B2

(12) United States Patent
Ekuni et al.

(10) Patent No.: US 10,304,435 B2
(45) Date of Patent: May 28, 2019

(54) MUSICAL INSTRUMENT AND ACOUSTIC TRANSDUCER DEVICE

(71) Applicant: YAMAHA CORPORATION, Hamamatsu-shi (JP)

(72) Inventors: Shingo Ekuni, Hamamatsu (JP); Tadaharu Kato, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/386,632

(22) Filed: Dec. 21, 2016

(65) Prior Publication Data

US 2017/0206881 A1 Jul. 20, 2017

(30) Foreign Application Priority Data

Jan. 20, 2016 (JP) ..... 2016-008462

(51) Int. Cl.
*G10H 3/14* (2006.01)
*G10D 1/08* (2006.01)
(Continued)

(52) U.S. Cl.
CPC ..... *G10H 3/146* (2013.01); *G10D 1/08* (2013.01); *G10H 1/045* (2013.01); *G10H 1/32* (2013.01);
(Continued)

(58) Field of Classification Search
CPC ..... G10H 3/146; G10H 1/045; G10H 1/32; G10H 2210/275; G10H 2220/461; G10D 1/08; H04R 1/025
(Continued)

(56) References Cited

U.S. PATENT DOCUMENTS 5,056,400 A * 10/1991 Wachi ..... G10H 3/18 84/600
6,800,797 B2 * 10/2004 Steiger, III ..... G10D 1/085 84/267
(Continued)

FOREIGN PATENT DOCUMENTS

EP 1968345 A2 9/2008
EP 2757552 A1 7/2014
(Continued)

OTHER PUBLICATIONS

Extended European Search Report issued in European Patent Application No. 17151129.8 dated Apr. 6, 2017.
(Continued)

*Primary Examiner* — Jianchun Qin
(74) *Attorney, Agent, or Firm* — Rossi, Kimms & McDowell LLP

(57) ABSTRACT

A musical instrument, including: an acoustic portion configured to generate sounds in accordance with a vibration; a plurality of soundboard braces attached to a flat surface of the acoustic portion; a bracket supported by two of the plurality of soundboard braces; and an acoustic transducer supported by the bracket and configured to vibrate the acoustic portion based on an acoustic signal inputted thereto, wherein the bracket is disposed so as to bridge the two of the plurality of soundboard braces, and the acoustic transducer vibrates the acoustic portion at a position between the two of the plurality of soundboard braces.

8 Claims, 13 Drawing Sheets

(51) Int. Cl.

| | |
|---|---|
| ***G10H 1/045*** | (2006.01) |
| ***G10H 1/32*** | (2006.01) |
| ***H04R 1/02*** | (2006.01) |
| *H04R 9/06* | (2006.01) |

(52) U.S. Cl.
CPC ..... *H04R 1/025* (2013.01); *G10H 2210/275* (2013.01); *G10H 2220/461* (2013.01); *G10H 2230/075* (2013.01); *H04R 1/021* (2013.01); *H04R 9/06* (2013.01)

(58) Field of Classification Search
USPC ..... 84/725
See application file for complete search history.

(56) References Cited

U.S. PATENT DOCUMENTS

| | | | | |
|---|---|---|---|---|
| 9,508,324 | B2 | 11/2016 | Ohnishi et al. | |
| 9,589,551 | B2 * | 3/2017 | Langberg ..... | G10H 3/14 |
| 2014/0202318 | A1 * | 7/2014 | Ohnishi ..... | G10C 3/06 84/723 |
| 2014/0202320 | A1 | 7/2014 | White et al. | |
| 2016/0071497 | A1 * | 3/2016 | Satoh ..... | G10C 1/02 84/723 |

FOREIGN PATENT DOCUMENTS

| | | | |
|---|---|---|---|
| JP | H09247779 | A | 9/1997 |
| JP | 3788382 | B2 | 6/2006 |
| JP | 2012150235 | A | 8/2012 |
| JP | 2013077000 | A | 4/2013 |
| JP | 2013077002 | A | 4/2013 |
| JP | 2015146030 | A | 8/2015 |

OTHER PUBLICATIONS

Office Action issued in European Appln. No. 17151129.8 dated Jun. 6, 2018.
Office Action issued in Japanese Appln. No. 2016-008462 dated Dec. 18, 2018. English translation provided.

* cited by examiner

MUSICAL INSTRUMENT AND ACOUSTIC TRANSDUCER DEVICE

CROSS REFERENCE TO RELATED APPLICATION

The present application claims priority from Japanese Patent Application No. 2016-008462, which was filed on Jan. 20, 2016, the disclosure of which is herein incorporated by reference in its entirety.

BACKGROUND

Technical Field

The present disclosure relates to an acoustic transducer device configured to vibrate a musical instrument and a musical instrument on which the acoustic transducer is installed.

Description of Related Art

Some of musical instruments are configured to emit sounds by vibrating a soundboard or the like by means of an acoustic transducer, as disclosed in Japanese Patent No. 3788382, for instance. In an electric acoustic guitar disclosed in Japanese Patent No. 3788382, a plurality of acoustic transducers are installed in its body. A pickup provided on a bridge of the electric acoustic guitar converts a vibration of strings into an electric signal and outputs to an amplifier in the body. The amplifier amplifies the inputted vibration and outputs to the acoustic transducer. The acoustic transducer vibrates a top board of the body in accordance with the signal inputted from the amplifier, so that sounds are emitted from the top board.

SUMMARY

The musical instruments having the acoustic transducer may suffer from a large variation in efficiency of conversion of the vibration into acoustic radiation depending upon an installation position or an installation structure of the acoustic transducer. It is thus desired to provide an acoustic transducer device which can be installed in an optimum condition and a musical instrument on which the acoustic transducer is installed in an optimum condition.

One aspect of the disclosure relates to an acoustic transducer device and a musical instrument that can enhance an efficiency of conversion of a vibration by an acoustic transducer into acoustic radiation.

In one aspect of the disclosure, a musical instrument includes: an acoustic portion configured to generate sounds in accordance with a vibration; a plurality of soundboard braces attached to a flat surface of the acoustic portion; a bracket supported by two of the plurality of soundboard braces; and an acoustic transducer supported by the bracket and configured to vibrate the acoustic portion based on an acoustic signal inputted thereto, wherein the bracket is disposed so as to bridge the two of the plurality of soundboard braces, and the acoustic transducer vibrates the acoustic portion at a position between the two of the plurality of soundboard braces.

The acoustic transducer is supported by the two soundboard braces via the bracket and vibrates the acoustic portion at a position between the two soundboard braces. Thus, the acoustic transducer efficiently converts the vibration into acoustic radiation.

In the musical instrument constructed as described above, the two of the plurality of soundboard braces may be adjacent two soundboard braces, and the acoustic transducer may vibrate the acoustic portion at a position middle between the adjacent two soundboard braces.

There is a high possibility that each of positions of the acoustic portion to which the soundboard braces are attached has an increased rigidity and accordingly becomes a node of the vibration. Consequently, there is a high possibility that a position middle between the adjacent two soundboard braces become an antinode of the vibration. In view of this, the acoustic transducer of the musical instrument vibrates the acoustic portion at the position middle between the adjacent two soundboard braces, so that it is possible to enhance the efficiency of conversion of the vibration into acoustic radiation.

In the musical instrument constructed as described above, the acoustic transducer may include a vibrating portion configured to vibrate in accordance with the acoustic signal and a cap disposed between the vibrating portion and the acoustic portion and configured to vibrate with the vibrating portion so as to transmit the vibration to the acoustic portion, and the cap may include a first tapered portion which is tapered in a direction from the vibrating portion toward the acoustic portion.

The vibrating portion of the acoustic transducer includes a coil, a magnet, etc., and accordingly has a certain size. The cap attached to the vibrating portion has also a certain size. A position corresponding to an antinode of a vibration of a specific frequency is one point in the acoustic portion, in a strict sense. In view of this, it is ideal that a vibrating position at which the acoustic transducer vibrates the acoustic portion coincides with the one point. In the present musical instrument, therefore, the cap includes the first tapered portion, so that a vibrating position at which the cap and the acoustic portion are in contact with each other can be made as close as possible to the one point corresponding to the antinode of the vibration. Further, because the cap has the first tapered portion, the vibrating position can be located as far as possible away from a position of a node of the vibration. For instance, the vibrating position is located far from a position of the acoustic portion at which the rigidity is high (i.e., a position of the acoustic portion at which the soundboard brace is disposed), so that the conversion efficiency to acoustic radiation is enhanced.

In the musical instrument constructed as described above, the cap may include a pressing portion through which a pressing force toward the acoustic portion is applied to the cap when the cap is fixed to the acoustic portion by bonding.

According to the musical instrument constructed as described above, when the first tapered portion of the cap is bonded to the acoustic portion, a worker presses the pressing portion by hand, and the first tapered portion is easily and reliably fixed to the acoustic portion.

The musical instrument constructed as described above may further comprise a pair of supporters respectively attached to the two of the plurality of soundboard braces so as to support the bracket, and each of the supporters may be held in contact with the acoustic portion at three or more support points which are not located on one straight line.

Each of the supporters is held in contact with the acoustic portion at three or more support points which are not located on one straight line, and the three or more points define a plane. It is consequently possible to keep a distance between the bracket and the acoustic portion constant.

In the musical instrument constructed as described above, each of the supporters may include at least one second tapered portion which is tapered in a direction from the bracket toward the acoustic portion.

The acoustic transducer is fixed to the acoustic portion with respect to a predetermined position and a predetermined plane of the acoustic portion in a state in which the acoustic portion is not vibrated. In the present musical instrument, the supporters are attached to the acoustic portion in a state in which a distal end of the second tapered portion of each supporter is in contact with the acoustic portion. Thus, the supporters are easily positioned when being attached to the acoustic portion.

In the musical instrument constructed as described above, each of the supporters may include a first plate portion and a second plate portion between which a corresponding one of the two of the plurality of soundboard braces is sandwiched, and the first plate portion and the second plate portion of each of the supporters may be fixed to the corresponding one of the two of the plurality of soundboard braces by bonding.

The supporter is fixed by bonding to the soundboard brace in a state in which the soundboard brace is held and sandwiched by and between the first plate portion and the second plate portion of the supporter. Thus, the supporter is fixed to the soundboard brace with high reliability.

In another aspect of the disclosure, a musical instrument comprises: an acoustic portion configured to generate sounds in accordance with a vibration, at least one supporter provided on the acoustic portion so as to be attached to a position of the acoustic portion corresponding to a node of a vibration generated in the acoustic portion, a bracket supported by the at least one supporter so as to extend therefrom; and an acoustic transducer supported by the bracket and configured to vibrate the acoustic portion in accordance with an acoustic signal inputted thereto, and wherein the acoustic transducer may vibrate a position of the acoustic portion corresponding to an antinode of the vibration generated in the acoustic portion.

According to the musical instrument constructed as described above, the supporter is attached to a position of the acoustic portion corresponding to a node of a vibration generated in the acoustic portion. In the acoustic portion, such as a soundboard, the rigidity is increased at positions thereof at which the soundboard braces are attached, for instance. These positions will probably become nodes of the vibration generated in the acoustic portion. The acoustic transducer configured to vibrate the acoustic portion is disposed with respect to a predetermined position and a predetermined plane of the acoustic portion in a state in which the acoustic portion is not vibrated, and it is preferable that the acoustic transducer be kept fixed at the initial position so as not to be shifted therefrom before, after, and during the vibrating motion. This is because the accuracy and the efficiency of conversion of the vibration into acoustic radiation are lowered if the acoustic transducer is shifted from the initial position before/after the vibrating motion. The supporter of the present musical instrument is attached to a position of the acoustic portion corresponding to a node of the vibration at which the amplitude of the vibration is considerably small or preferably zero. The acoustic transducer is supported by the supporter via the bracket, so that the acoustic transducer is prevented from being shifted from the initial position before and after the vibrating motion. Further, the acoustic transducer is provided so as to vibrate a position of the acoustic portion corresponding to an antinode of the vibration. Consequently, the acoustic transducer converts the vibration into acoustic radiation with high efficiency. In the acoustic portion, the positions that become the nodes of the vibration can be confirmed for every frequency in advance by simulation or the like. It is assumed that a multiplicity of vibrations having different levels of frequencies exist for the acoustic portion. For instance, the vibration for which the positions of the antinode and the node are determined is a vibration having a low frequency (bass), whereby bass sounds with a sense of realism can be generated. The positions of the antinode and the node may be determined for a vibration having a frequency preferred by a user.

In the musical instrument constructed as described above, at least one of the at least one supporter may be attached to one of a neck block and an end block.

In the musical instrument constructed as described above, the acoustic portion may be shaped like a plate and includes a plurality of soundboard braces provided on a flat surface of the acoustic portion, and at least one of the at least one supporter may be attached to one of the plurality of soundboard braces.

In the musical instrument constructed as described above, the acoustic portion may be shaped like a plate and includes a plurality of soundboard braces provided on a plane of the acoustic portion, the at least one supporter may include a pair of supporters, and the supporters may be respectively attached to two of the plurality of soundboard braces.

The acoustic portion formed of wood or the like may suffer from warpage due to changes over years. In this instance, the positions of the soundboard braces are displaced in accordance with warpage of the acoustic portion. As a result, the acoustic transducer is shifted relative to the acoustic portion, specifically, the vibrating position at which the acoustic transducer contacts the acoustic portion is shifted, so that the conversion efficiency of the vibration to acoustic radiation may be undesirably lowered. In the present musical instrument, the bracket is provided so as to bridge the two soundboard braces via the supporters respectively attached to the two soundboard braces. In this configuration, the supporters are deformed in accordance with warpage of the acoustic portion, so that the vibrating position is prevented from being shifted. It is consequently possible in the present musical instrument to prevent the conversion efficiency to acoustic radiation from being lowered even after a long period of use of the musical instrument.

In the musical instrument constructed as described above, the at least one supporter may be attached to an outside of a side board of the musical instrument.

It is noted that the present disclosure is not limited to the musical instrument having the acoustic transducer, but may be embodied as an acoustic transducer device configured to vibrate the acoustic portion.

According to the present musical instrument and the present acoustic transducer device, it is possible to enhance the efficiency of conversion of the vibration to acoustic radiation.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Figure 1:
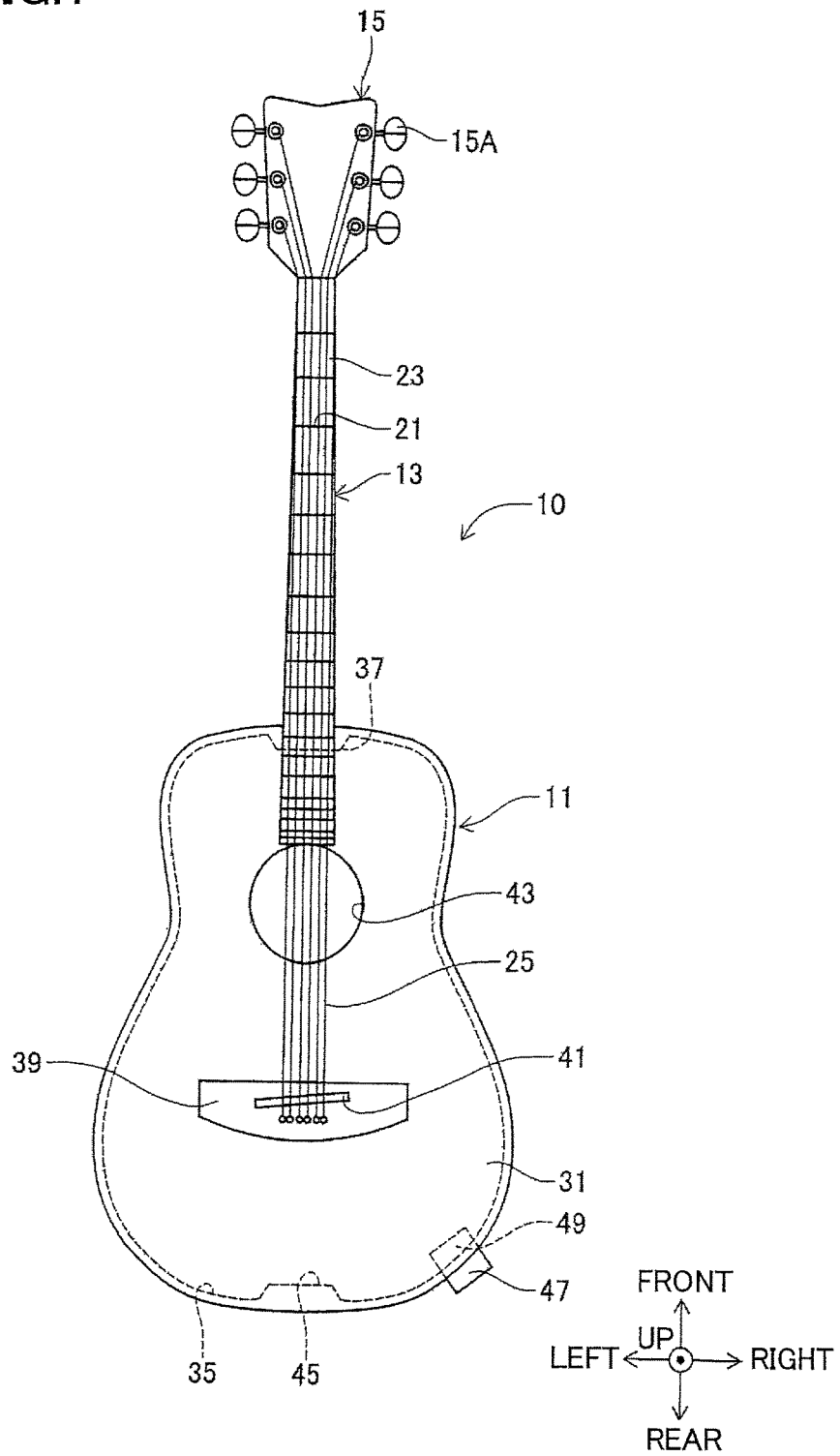
FIG. 1 is a plan view of a guitar according to one embodiment.
Figure 2:
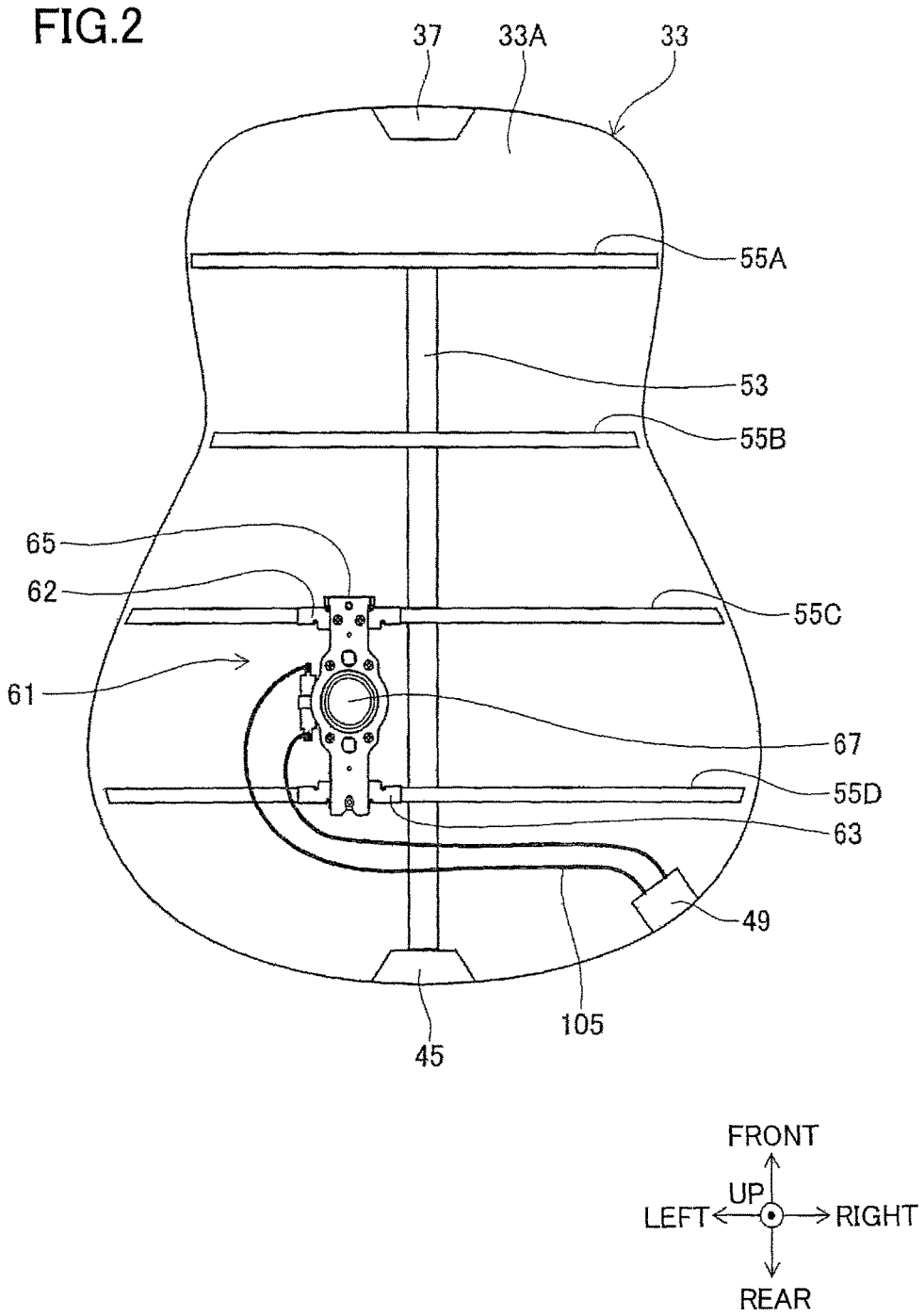
FIG. 2 is a plan view showing an inner side of a back board of a body of the guitar.

Referring to the plan view of FIG. 1, there will be explained a guitar 10, as one example of a musical instrument, according to one embodiment of the present disclosure. FIG. 1 is a plan view of the guitar 10. FIG. 2 shows an inner side of a back board 33 of a body 11 of the guitar 10. The guitar 10 is the so-called acoustic guitar and includes the body 11, a neck 13 coupled to the body 11, and a head 15 attached to a distal end of the neck 13.

The neck 13 is shaped like a rod extending in one direction. The neck 13 is fixed at its proximal end portion to the body 11. A fingerboard 23 including a plurality of frets 21 is attached onto the neck 13. In the following explanation, as shown in FIGS. 1 and 2, a distal-end side of the neck 13 (on which the head 15 is provided) will be referred to as a front side, a proximal-end-side of the neck 13 (on which the body 11 is provided) will be referred to as a rear side. A direction perpendicular to this front-rear direction and substantially parallel to the surfaces of the neck 13 and the body 11 will be referred to as a right-left direction. A direction perpendicular to the front-rear direction and the right-left direction will be referred to as an up-down direction. According to the definition, a direction in which the neck 13 extends is parallel to the front-rear direction.

As shown in FIGS. 1 and 2, the body 11 is formed as a resonance box which is a hollow box constituted by a top board 31, the back board 33, and a side board 35. The body 11 has a predetermined thickness in the up-down direction and has a constricted portion which is located intermediate in the front-rear direction and which is curved in the right-left direction. The body 11 is made of wood such as spruce, cedar, rosewood, or mahogany.

A heel (not shown) at a rear end of the neck 13 is bonded or bolted to a neck block 37 provided at a front end portion of the body 11. In the guitar 10 of the present embodiment, six strings 25 are stretched between the head 15 provided at the front end of the neck 13 and a bridge 39 attached to the top board 31 of the body 11. Tension given to each string 25 is changed for tuning by turning a corresponding one of six pegs 15A provided on the head 15.

A saddle 41 is provided on the bridge 39. The saddle 41 supports the strings 25 from below and keeps the string height above the fingerboard 23 of the neck 13 constant. Vibration of the strings 25 is transmitted to the body 11 via the saddle 41 and the bridge 39 that supports the saddle 41. In the top board 31 of the body 11, a sound hole 43 is formed at a position behind the neck 13. Sounds resonated in the inner space of the body 11 are emitted outside from the sound hole 43.

The back board 33 has a shape substantially identical to the top board 31 as viewed from the up-down direction. The side board 35 is provided along curved outer peripheral portions of the top board 31 and the back board 33, so as to connect the top board 31 and the back board 33 in the up-down direction. An end block 45 is provided at a rear end portion of the back board 33. The neck block 37 and the end block 45 firmly fix the top board 31, the back board 33, and the side board 35 to each other. Each of the neck block 37 and the end block 45 functions as a reinforcing member for increasing the rigidity of the body 11 with respect to tension of the strings 25.

As shown in FIG. 2, a separation preventive member 53 and four soundboard braces 55A, 55B, 55C, 55D are attached to an inner surface 33A of the back board 33. The separation preventive member 53 and the soundboard braces 55A-55D are fixed by bonding to the inner surface 33A at respective positions. An adhesive used to fix the separation preventive member 53 and the soundboard braces 55A-55D is glue, for instance, which ensures a high bonding strength without adversely affecting sounds to be generated. The shapes, the number, and the positions of the separation preventive member 53 and the soundboard braces 55A-55D shown in FIG. 2 may be suitably changed for the purpose of increasing the rigidity, adjusting the tone color, and so on.

The separation preventive member 53 is a plate-like member provided on the inner surface 33A so as to be positioned at a central portion of the back board 33 in the right-left direction and so as to extend in the front-rear direction on the inner surface 33A. The back board 33 is formed by bonding two plates at the middle in the right-left direction, and the separation preventive member 53 prevents the two plates of the back board 33 from being separated from each other. The four soundboard braces 55A-55D are disposed so as to be spaced apart from one another in the front-rear direction at suitable intervals, and extend in the right-left direction on the inner surface 33A. An acoustic transducer device 61 is attached to rear-side two soundboard braces 55C, 55D (as one example of adjacent two soundboard braces) among the four soundboard braces 55A-55D. The acoustic transducer device 61 is attached to the two soundboard braces 55C, 55D on the left side of the separation preventive member 53. The position of the acoustic transducer device 61 may be suitably changed depending upon the positions, etc., of the separation preventive member 53 and the soundboard braces 55A-55D.

Figure 3:
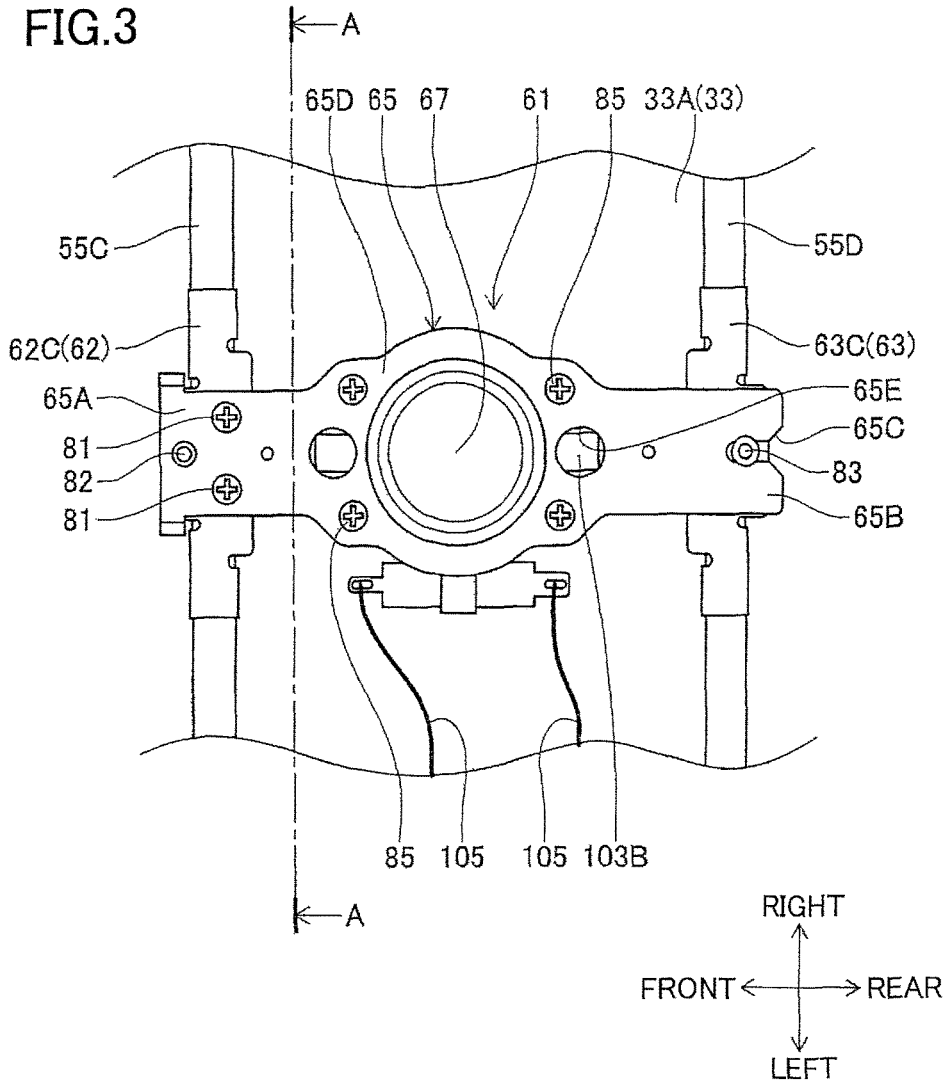
FIG. 3 is an enlarged view of a portion of the back board on which the acoustic transducer device is installed.
Figure 4:
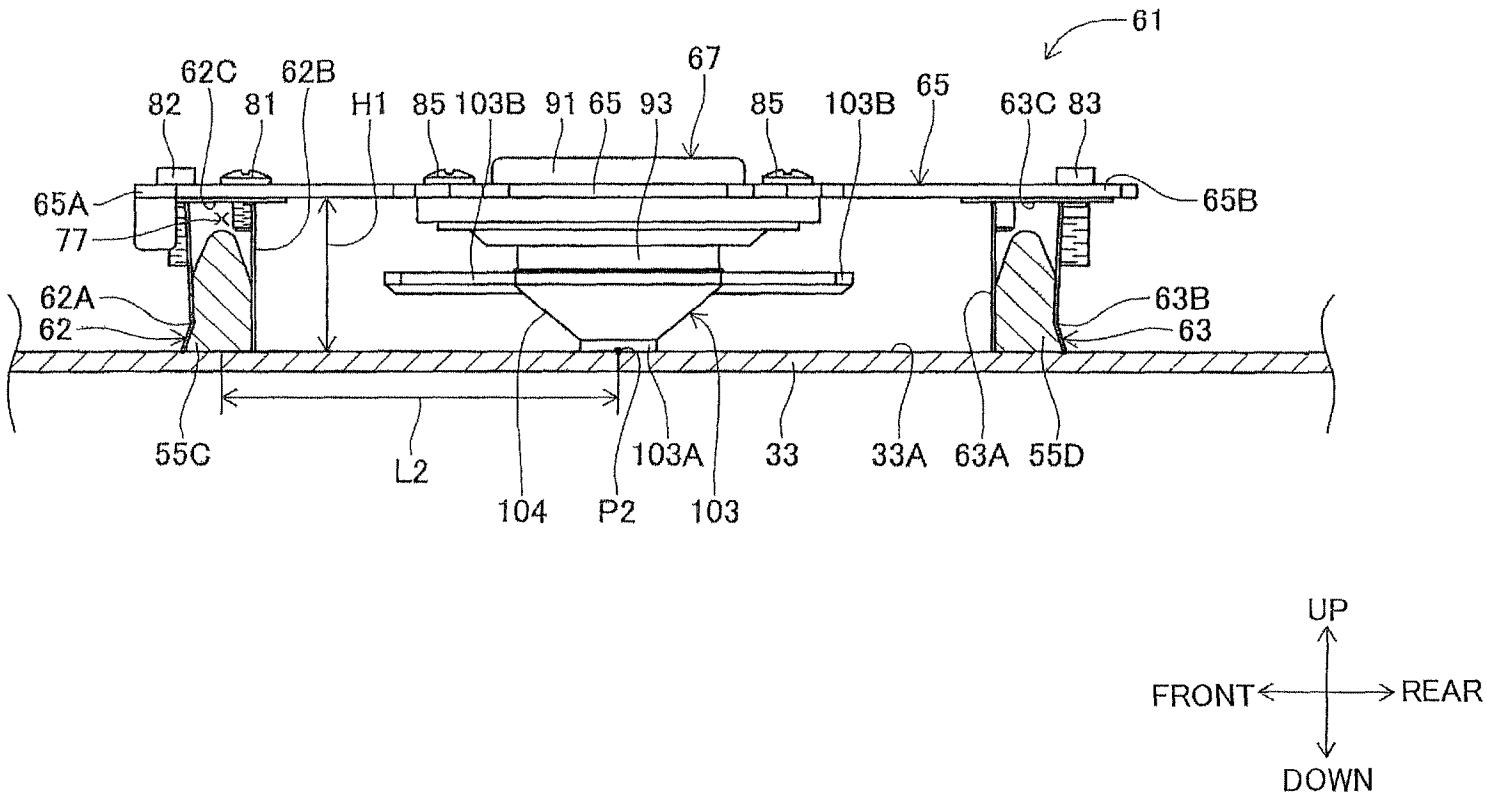
FIG. 4 is a side view of the acoustic transducer device.

The acoustic transducer device 61 includes a pair of supporters 62, 63, a bracket 65, and an acoustic transducer 67. FIG. 3 is an enlarged view of a portion of the back board 33 on which the acoustic transducer device 61 is installed. FIG. 4 is a side view of the acoustic transducer device 61. As shown in FIGS. 3 and 4, the supporter 62 is attached to the front-side soundboard brace 55C, and the supporter 63 is attached to the rear-side soundboard brace 55D. In the present embodiment, the supporters 62, 63 are identical in structure. In view of this, components common to the two supporters 62, 63 will be explained referring mainly to the supporter 62, and an explanation of the supporter 63 is accordingly omitted where appropriate.

The supporter 62 is formed by bending a metal plate, for instance. The supporter 62 has a front plate 62A, a rear plate 62B, and an upper plate 62C that connects the front plate 62A and the rear plate 62B. The supporter 62 has a generally inverted U-shape opening downward as viewed from the right-left direction and extends along the right-left direction. A distance between the front plate 62A and the rear plate 62B in the front-rear direction corresponds to a thickness of the soundboard brace 55C in the front-rear direction.

Figure 5:
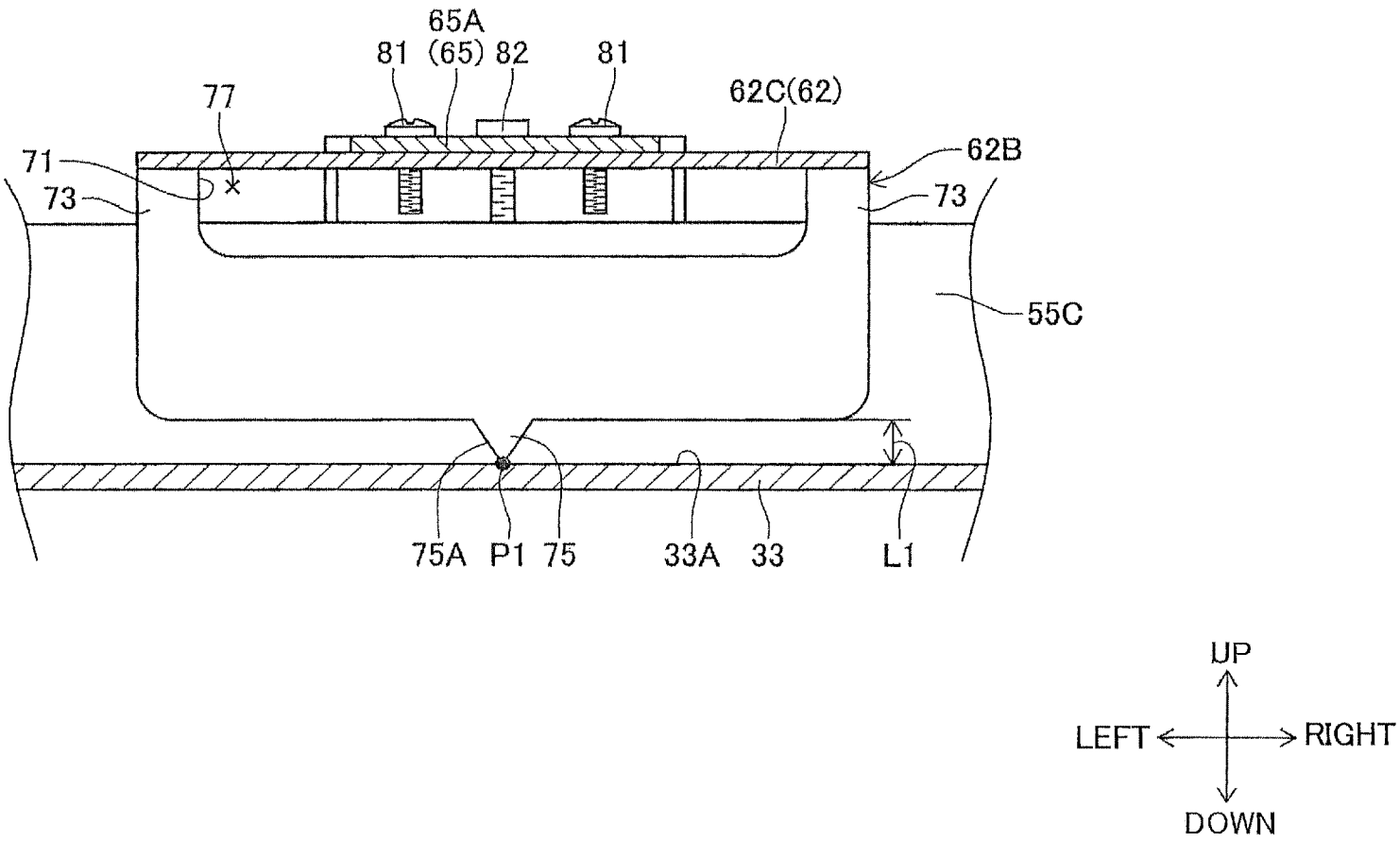
FIG. 5 is a cross-sectional view taken along line A-A in FIG. 3.

FIG. 5 is a cross sectional view taken along line A-A in FIG. 3 in which the supporter 62 and the soundboard brace 55C are viewed from the rear plate (62B) side, i.e., from the rear side. As shown in FIG. 5, the rear plate 62B is held in point contact with the back board 33 at only one support point P1. As shown in FIGS. 3 and 4, the soundboard brace 55C is a generally long plate-like member that is longer in the up-down direction and the right-left direction than in the front-rear direction. The soundboard brace 55C is disposed such that its lower end face is fixed to the inner surface 33A of the back board 33. As shown in FIG. 5, the rear plate 62B is a plate-like member extending in the up-down direction along a rear side surface of the soundboard brace 55C and extending in the right-left direction. A through-hole 71, which is long in the right-left direction, is formed in an upper portion of the rear plate 62B to which the upper plate 62C is connected. The through-hole 71 is formed at a central portion of the rear plate 62B in the right-left direction. The rear plate 62B is connected to the upper plate 62C at a pair of connecting portions 73 that are opposed to each other in the right-left direction with the through-hole 71 interposed therebetween. In this configuration, the rear plate 62B has a generally U-shape the bottom of which is defined by its lower portion when viewed from the rear side.

The rear plate 62B has a contact portion 75 formed at its lower end portion located middle in the right-left direction. The contact portion 75 protrudes downwardly from a lower edge of the rear plate 62B (i.e., the bottom of the U-shape) and has a tapered portion 75A whose width in the right-left direction gradually reduces in the downward direction. The thus formed rear plate 62B is fixed to the soundboard brace 55C such that only the protruding distal end of the contact portion 75 is held in point contact with the inner surface 33A at the support point P1 and other portion of the rear plate 62B is spaced from the back board 33 in the up-down direction by a distance L1. The support point P1 is located at the same position in the right-left direction as a vibrating position P2 (FIG. 4) which is a center of contact between the acoustic transducer 67 and the back board 33.

Figure 6:
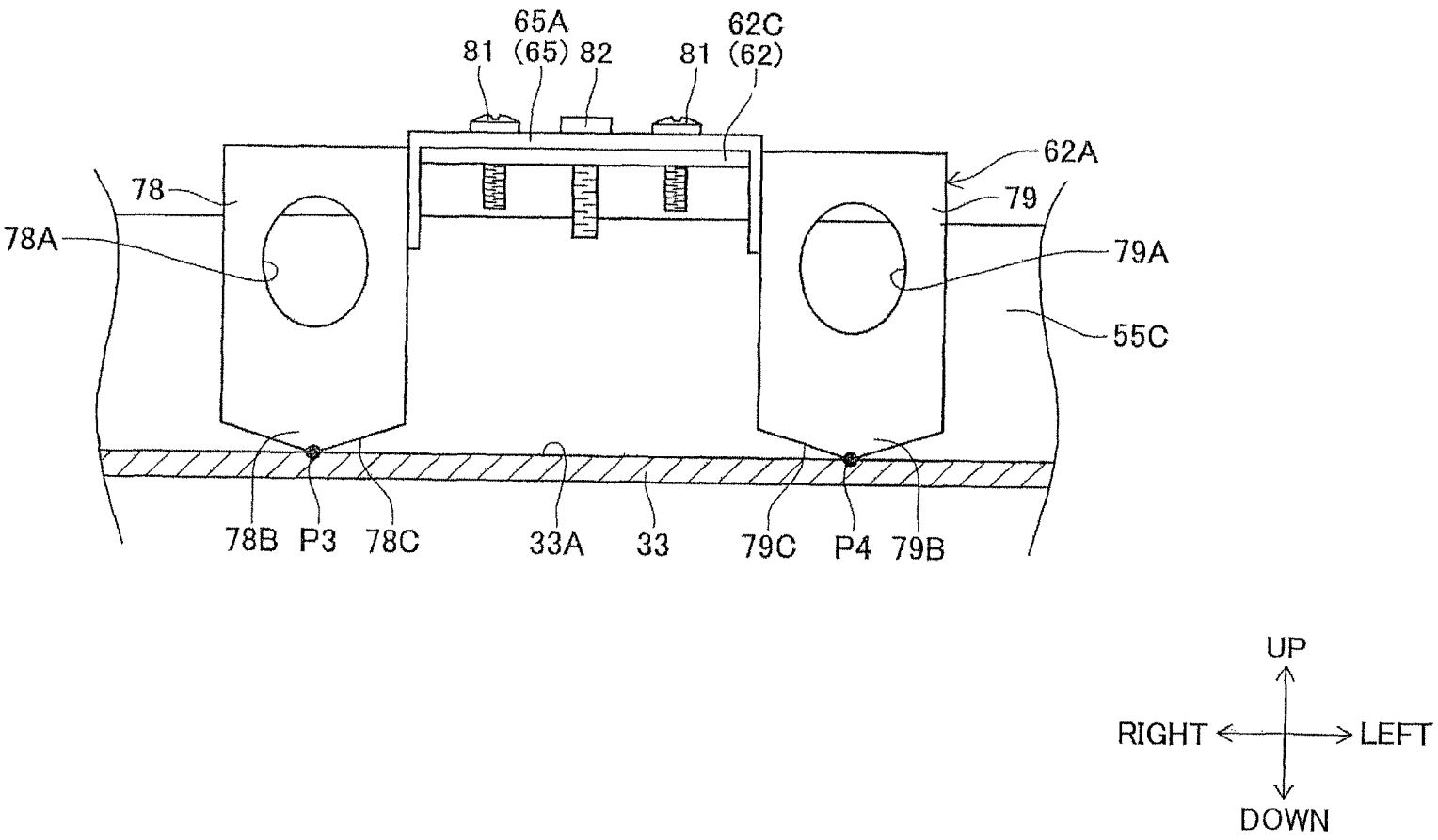
FIG. 6 is a side view of a supporter and a soundboard brace as seen from a front side.

FIG. 6 is a view of the supporter 62 and the soundboard brace 55C as viewed from the front side, i.e., from the front plate (62A) side. As shown in FIG. 6, the front plate 62A is constituted by two plate members, i.e., a right-side first front plate 78 and a left-side second front plate 79. As shown in FIG. 6, each of the first and second front plates 78, 79 has a constant width in the right-left direction and extends in the up-down direction along a front side surface of the soundboard brace 55C. Each of the first and second front plates 78, 79 has a generally rectangular shape that is long in the up-down direction as viewed from the front side. Through-holes 78A, 79A, each of which has an oval shape that is long in the up-down direction, are respectively formed in the first and second front plates 78, 79. Upper ends of the respective first and second front plates 78, 79 are connected to the upper plate 62C.

The first front plate 78 has a contact portion 78B formed at its lower end portion located middle in the right-left direction. The contact portion 78B protrudes downwardly from a lower portion of the first front plate 78 and has a tapered portion 78C whose width in the right-left direction gradually reduces in the downward direction. Similarly, the second front plate 79 has a contact portion 79B formed at its lower end portion located middle in the right-left direction. The contact portion 79B protrudes downwardly from a lower portion of the second front plate 79 and has a tapered portion 79C whose width in the right-left direction gradually reduces in the downward direction. Each of the contact portions 78B, 79B inclines rearward as it extends upward from its lower end portion (FIG. 4).

The first front plate 78 is fixed to the soundboard brace 55C such that only the protruding distal end of the contact portion 78B is held in point contact with the inner surface 33A at a support point P3 and other portion of first front plate 78 is spaced from the back board 33 in the up-down direction. Similarly, the second front plate 79 is fixed to the soundboard brace 55C such that only the protruding distal end of the contact portion 79B is held in point contact with the inner surface 33A at a support point P4 and other portion of the second front plate 79 is spaced from the back board 33 in the up-down direction. The support point P1 of the rear plate 62B is not located on a straight line that connects the support points P3, P4. Thus, the supporter 62 is in contact with the inner surface 33A at the three points that are not located on one straight line, and a plane is defined by the three points, whereby a height H1 (FIG. 4) of the upper plate 62C from the back board 33 is kept constant.

As shown in FIG. 4, the soundboard brace 55C is inserted, from below, between the front and rear plates 62A, 62B in the front-rear direction. In this state, the supporter 62 supports the soundboard brace 55C such that the front plate 62A (as one example of a first plate portion) and the rear plate 62B (as one example of a second plate portion) hold and sandwich the soundboard brace 55C therebetween. The supporter 62 is fixed to the soundboard brace 55C by an adhesive, for instance, with the soundboard brace 55C held by the supporter 62.

As shown in FIGS. 3 and 4, the upper plate 62C of the supporter 62 connects upper end portions of the front plate 62A and the rear plate 62B. The upper plate 62C is a flat plate and has a substantially rectangular shape that is long in the right-left direction as viewed from the up-down direction. An upper end portion of the soundboard brace 55C has an arcuate shape, i.e., a round curved shape (FIG. 4). As shown in FIG. 4, a clearance 77 is formed between the upper end portion of the upper plate 62C and the upper end portion of the soundboard brace 55C in the up-down direction. A front end portion 65A of the bracket 65 is fixed to a central portion of the upper plate 62C in the right-left direction.

The bracket 65 is a flat metal member and extends along the front-rear direction. The shape and the material of the bracket 65 are selected such that the bracket 65 has higher rigidity than the supporters 62, 63. The bracket 65 is supported by the pair of supporters 62, 63 so as to bridge the two soundboard braces 55C, 55D. The bracket 65 has a width in the right-left direction larger at its central portion 65D in the front-rear direction than the other portion. The front end portion 65A of the bracket 65 is superposed on the upper plate 62C of the supporter 62 and is fixed to the upper plate 62C by two screws 81 and one hexagon socket head cap screw 82 which extend through the front end portion 65A and the upper plate 62C in the up-down direction. The screws 81 and the hexagon socket head cap screw 82 are screwed in respective threaded portions formed in the upper plate 62C. The bracket 65 may be fixed to the supporter 62 otherwise. For example, the bracket 65 may be fixed to the upper plate 62C only by the hexagon socket head cap screw 82. In this instance, the supporter 62 is provided with holes into which the screws 81 are inserted and which do not have threaded portions, and the two screws 81 may be utilized only for positioning the bracket 65 relative to the upper plate 62C.

The rear-side supporter 63 is similar to the front-side supporter 62 in structure and includes a front plate 63A, a rear plate 63B, and an upper plate 63C. The supporter 63 has a generally inverted U-shape opening downward when viewed from the right-left direction. The supporter 63 is held in point contact with the back board 33 at only three contact points (similar to the support point P1 shown in FIG. 5 and the support points P3, P4 shown in FIG. 6). The contact point of the supporter 63 corresponding to the support point P1 is also located at the same position, in the right-left direction, as the vibrating position P2 (FIG. 4) at which the acoustic transducer 67 and the back board 33 contact each other.

The supporter 63 is fixed to the soundboard brace 55D such that the front plate 63A and the rear plate 63 hold and sandwich the soundboard brace 55D from its opposite sides in the front-rear direction. A rear end portion 65B of the bracket 65 is fixed to a central portion of the upper plate 63C of the supporter 63 in the right-left direction. The bracket 65 is supported by the supporter 62 and the supporter 63, whereby the bracket 65 is kept at a position spaced upward from the inner surface 33A of the back board 33 by a suitable height H1 (FIG. 4).

The rear end portion 65B of the bracket 65 is superposed on the upper plate 63C of the supporter 63 and is fixed thereto by one hexagon socket head cap screw 83. The hexagon socket head cap screw 83 is screwed in a threaded portion formed in the upper plate 63C.

The rear end portion 65B has a groove 65C formed by cutting out a rear end of the rear end portion 65B frontward. The groove 65C has a size according to a size of a body portion of the hexagon socket head cap screw 83. The body portion of the hexagon socket head cap screw 83 is inserted in the groove 65C, and a head portion thereof engages with the groove 65C. The bracket 65 is slidable in the front-rear direction with the hexagon socket head cap screw 83 inserted in the groove 65C. According to the arrangement, in a state in which the position of the bracket 65 is adjusted in the front-rear direction, the hexagon socket head cap screw 83 is tightened so as to fix the bracket 65 to the supporter 63.

Figure 7:
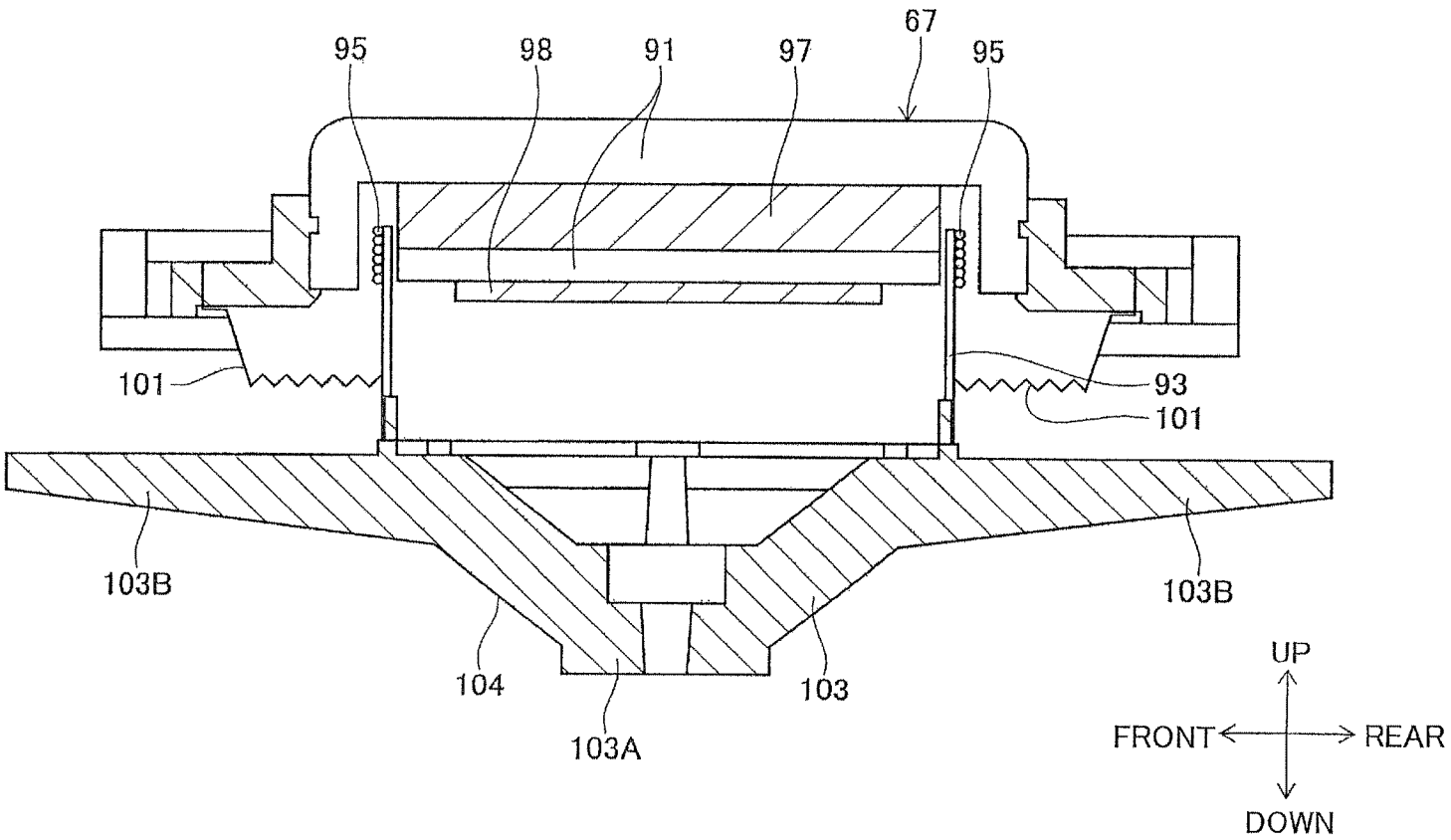
FIG. 7 is a view schematically showing a cross section of an acoustic transducer of the acoustic transducer device.

The acoustic transducer 67 is attached to the central portion 65D of the bracket 65. FIG. 7 is a cross-sectional view schematically showing the acoustic transducer 67. As shown in FIGS. 4 and 7, a yoke 91 of the acoustic transducer 67 is formed so as to cover an upper portion of the acoustic transducer 67. The yoke 91 is partially inserted, from below, in an attachment hole formed in the central portion 65D of the bracket 65. The yoke 91 is fixed to the central portion 65D by bonding, for instance. The yoke 91 is fixed to the bracket 65 also by screws 85 in a state in which the yoke 91 is partially inserted in the attachment hole. The bracket 65 and the acoustic transducer 67 may be fixed otherwise. In the acoustic transducer 67, a voice coil 95 is wound around a coil bobbin 93. In the upper portion of the acoustic transducer 67, there are provided a magnet 97 and a cancel magnet 98 whose polarities repel each other. The magnet 97 and the cancel magnet 98 are disposed so as to be opposed to each other in the up-down direction. The voice coil 95 is disposed between the magnet 97 and the cancel magnet 98 such that magnetic fluxes of the magnet 97 and the cancel magnet 98 interlink each other. A neodymium magnet is used as each of the magnet 97 and the cancel magnet 98, for instance.

A spring 101 of the acoustic transducer 67 holds the coil bobbin 93 such that the coil bobbin 93 can vibrate with respect to the yoke 91 in the up-down direction. Thus, the coil bobbin 93 can vibrate with respect to the bracket 65 in the up-down direction through the spring 101 and the yoke 91. The acoustic transducer 67 is configured such that, when an electric current flows through the voice coil 95, the coil bobbin 93 and the voice coil 95 vibrate in the up-down direction. A cap 103 is attached to a lower end of the coil bobbin 93. The cap 103 vibrates with the coil bobbin 93 in the up-down direction.

The cap 103 has a generally conical shape whose diameter gradually reduces downward. The cap 103 has a tapered portion 104 that tapers downward. At a lower end of the cap 103, a circular disc-like distal end portion 103A is formed. A lower surface of the distal end portion 103A is held in contact with and fixed to the inner surface 33A of the back board 33. The distal end portion 103A is fixed to the inner surface 33A by bonding, for instance. The center of the circular lower surface of the distal end portion 103A corresponds to the above-indicated vibrating position P2 (FIG. 4).

As shown in FIG. 1, an input portion 47 is provided at the rear-side portion of the side board 35 for connection with an external sound source. An acoustic signal inputted from the input portion 47 is amplified by an amplifier 49 in the body 11 and is inputted to the acoustic transducer 67 of the acoustic transducer device 61 via an acoustic cable 105 (FIG. 2). The acoustic transducer 67 inputs, to the voice coil 95 (FIG. 3), an electric current in accordance with the acoustic signal. When the electric current is inputted to the voice coil 95, the coil bobbin 93 and the cap 103 reciprocate in the up-down direction so as to vibrate. The back board 33 vibrates with the cap 103 and converts the vibration of the acoustic transducer 67 into acoustic radiation.

In the present embodiment, the separation preventive member 53 and the soundboard braces 55A-55D, each as the reinforcing member, are fixed to the back board 33, so that the back board 33 has higher rigidity at portions thereof to which the soundboard braces 55A, etc., are fixed, as compared with other portions. Consequently, there is a high possibility that a connected portion of the soundboard brace 55C and the back board 33 shown in FIG. 4, for instance, becomes a node of a vibration generated in the back board 33. The supporters 62, 63 are respectively attached to the soundboard braces 55C, 55D corresponding to the nodes.

In contrast, portions of the back board 33 which are away from the separation preventive member 53 and the soundboard braces 55A-55D have lower rigidity, so that there is a high possibility that the portions become antinodes of the vibration. In the acoustic transducer 67 of the present embodiment, a middle position between the soundboard braces 55C, 55D in the front-rear direction is set as the vibrating position P2. In this instance, a distance L2 between the soundboard brace 55C and the vibrating position P2 corresponds to an odd multiple of a quarter (¼) of a period of a subject vibration, namely, corresponds to a position of the antinode. The position of the antinode in the back board 33 can be set to an optimum position by performing simulation in advance and analyzing actual acoustic radiation, for instance. In this case, the distance L2 indicated above may be adjusted to an optimum distance. In the thus constructed acoustic transducer 67, the acoustic transducer 67 is supported by the supporters 62, 63 disposed at the respective positions corresponding to the nodes which unlikely to vibrate, and the vibrating position P2 is set to the position corresponding to the antinode which is to be vibrated, so that the vibration is efficiently converted into acoustic radiation.

The cap 103 has a pair of pressing portions 103B each extending outward from an outer circumferential surface of the cap 103 in the front-rear direction. The pressing portions 103B are shaped like a plate. An upper surface of each pressing portion 103B is a flat surface extending along the front-rear direction and the right-left direction. As shown in FIG. 3, through-holes 65E are formed in the bracket 65 in accordance with the position and the size of the pressing portions 103B. In this arrangement, when the acoustic transducer 67 is bonded to the back board 33 in an assembly process of the guitar 10, a worker inserts his/her fingers or a tool into the through-holes 65E and presses the two pressing portions 103B down toward the back board 33, whereby the distal end portion 103A is firmly fixed to the inner surface 33A. The distal end portion 103A is fixed by an adhesive to the inner surface 33A of the back board 33.

In the present embodiment, the back board 33 is one example of an acoustic portion. The voice coil 95 and the coil bobbin 93 are one example of a vibrating portion. The tapered portion 104 is one example of a first tapered portion. Each of the tapered portions 75A, 78C, 79C is one example of a second tapered portion.

According to the embodiment described above, the following advantages are offered.

Advantage 1

The supporters 62, 63 of the acoustic transducer device 61 are respectively attached to the soundboard braces 55C, 55D which will probably become the nodes of the vibration generated in the back board 33. The acoustic transducer 67 of the acoustic transducer device 61 is supported by the supporters 62, 63 via the bracket 65, so that the acoustic transducer 67 is prevented from being shifted before and after the vibrating motion. Further, in the acoustic transducer 67, the vibrating position P2 (FIG. 4) is set to the position corresponding to the antinode of the vibration. Thus, the acoustic transducer 67 efficiently converts the vibration into acoustic radiation.

Advantage 2

The supporters 62, 63 are respectively attached to the soundboard braces 55C, 55D which are for increasing the rigidity of the back board 33. The portions of the back board 33, at which the soundboard braces 55C, 55D are fixed, have increased rigidity and probably become the nodes of the vibration. In the acoustic transducer device 61 of the present embodiment, therefrom, the supporters 62, 63 are respectively attached to the soundboard braces 55C, 55D, so that it is possible to enhance the efficiency of conversion of the vibration into acoustic radiation.

Advantage 3

The bracket 65 is supported by the pair of supporters 62, 63 and bridges the two soundboard braces 55C, 55D. In the acoustic transducer 67, the distal end portion 103A of the cap 103 is held in contact with the back board 33 at the vibrating position P2. Thus, even if the back board 33 suffers from warpage in the downward or upward direction in FIG. 4 due to a change over years, the supporters 62, 63 are displaced with the soundboard braces 55C, 55D.

Figure 8:
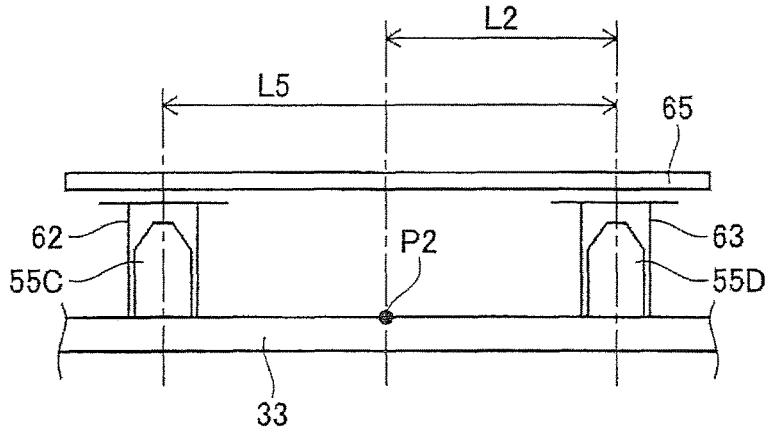
FIG. 8 is a schematic view showing a state before the back board suffers from warpage.
Figure 9:
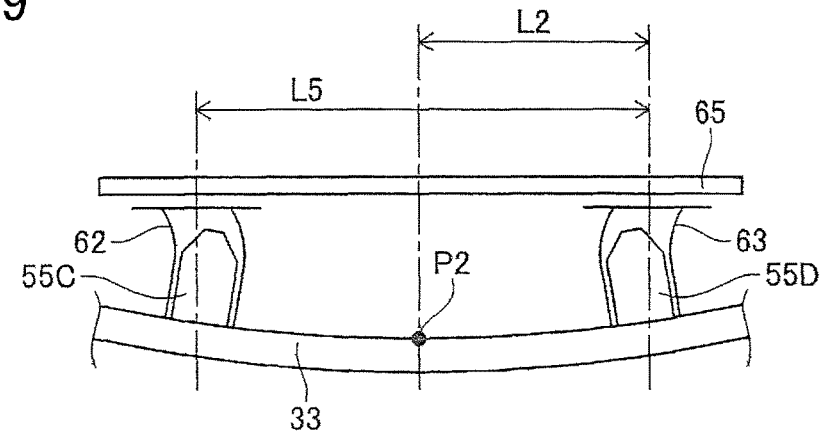
FIG. 9 is a schematic view showing a state in which the back board suffers from upward warpage.
Figure 10:
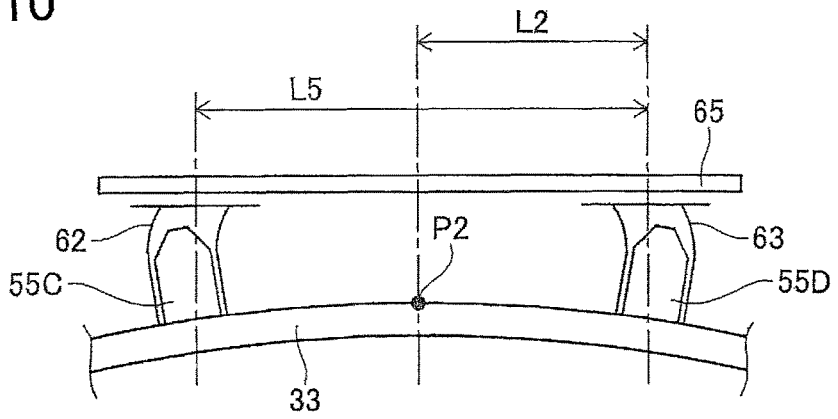
FIG. 10 is a schematic view showing a state in which the back board suffers from downward warpage.

FIG. 8 schematically shows the bracket 65, the supporter 62, and the back board 33 of the present embodiment, in a state in which the back board 33 does not suffer from warpage. FIG. 9 shows a state in which the back board 33 suffers from upward warpage. FIG. 10 shows a state in which the back board 33 suffers from downward warpage. In FIGS. 8-10, the acoustic transducer 67 is not illustrated for brevity's sake.

In the present embodiment, the bracket 65 has rigidity higher than the supporters 62, 63. When the back board 33 suffers from warpage as shown in FIGS. 9 and 10, the supporters 62, 63 are curved in accordance with warpage. In contrast, the bracket 65 having higher rigidity is supported by the supporters 62, 63 which are easily curved and is kept in a horizontal posture similar to that shown in FIG. 8 before the back board 33 suffers from warpage. As a result, in an instance where a distance between the supporters 62, 63 is L5, the vibrating position P2 is kept located at a position away from the supporter 63 by a distance L5/2, namely, a position away from the supporter 63 by the distance L2. The vibrating position P2 always corresponds to an apex (an inflection point) of the back board 33 that deforms. In the guitar 10 of the present embodiment, therefore, the supporters 62, 63 are deformed in accordance with warpage of the back board 33, so that the vibrating position P2 is prevented from being shifted. Thus, the guitar 10 of the present embodiment prevents or reduces a decrease in the conversion efficiency to acoustic radiation even after a long period of use.

Advantage 4

The acoustic transducer device 61 is fixed to the two soundboard braces 55C, 55D adjacent to each other in the front-rear direction, and the middle position between the two soundboard braces 55C, 55D in the front-rear direction is set as the vibrating position P2. It is very likely that the middle position between the adjacent two soundboard braces 55C, 55D which probably become the nodes of the vibration becomes the antinode of the vibration. In the present guitar 10, therefore, the middle position between the adjacent soundboard braces 55C, 55D is vibrated, resulting in higher efficiency of conversion of the vibration into acoustic radiation.

Advantage 5

The acoustic transducer device 61 is configured such that an electric current in accordance with a externally inputted acoustic signal is inputted to the voice coil 95, whereby the coil bobbin 93 and the cap 103 are vibrated in the up-down direction. The cap 103 has the tapered portion 104 (as one example of a first tapered portion) which tapers downward. In the acoustic transducer device 61 of the present embodiment, owing to the tapered portion 104 of the cap 103, the vibrating position P2 at which the cap 103 and the back board 33 contact each other can be made as close as possible to one point corresponding to the antinode of the vibration.

At positions of the back board 33 away from its positions to which the soundboard braces 55C, 55D are fixed and the back board 33 has accordingly increased rigidity, the back board 33 has lower rigidity and is accordingly likely to vibrate. Owing to the tapered portion 104 of the cap 103, the vibrating position P2 can be located as far away as possible from, in the front-rear direction, the positions of the supporters 62, 63 at which the rigidity of the back board 33 is high. It is thus possible to enhance the conversion efficiency into acoustic radiation.

Advantage 6

The cap 103 has the pressing portions 103B which extend outward from the outer circumferential surface in the front-rear direction. The bracket 65 has the through-holes 65E formed in accordance with the position and the size of the pressing portions 103B. In this arrangement, when the acoustic transducer 67 is bonded to the back board 33, the worker who performs an assembly work of the guitar 10 inserts his or her fingers and a tool in the through-holes 65E and presses the two pressing portions 103B down toward the back board 33, so that the distal end portion 103A can be firmly fixed to the inner surface 33A. Thus, when the acoustic transducer 67 vibrates in the up-down direction, not only a motion for pushing the back board 33 downward by the cap 103, but also a motion for pulling up the back board 33 can be appropriately conducted. As a result, the acoustic transducer 67 can efficiently transmit the vibration to the back board 33. The distal end portion 103A is bonded by an adhesive to the inner surface 33A of the back board 33, so that, when the motion for pulling up the back board 33 is conducted in vibration of the acoustic transducer 67 in the up-down direction, the acoustic transducer 67 can move the back board 33 upward with high reliability. Thus, the acoustic transducer 67 can accurately transmit sounds (vibration) to the back board 33.

Advantage 7

The supporter 62 has the tapered portions 75A, 78C, 79C (each as one example of a second tapered portion) as shown in FIG. 5. The rear plate 62B is fixed to the soundboard brace 55C in a state in which only the protruding distal end of the contact portion 75 is held in point contact with the inner surface 33A at the support point P1 and other portion of the rear plate 62B is spaced away from the back board 33 in the up-down direction by the distance L1. The front plate 62A is fixed to the soundboard brace 55C in a state in which only the distal ends of the contact portions 78B, 79B are held in point contact with the inner surface 33A at the support points P3, P4 and other portion of the front plate 62A is spaced away from the back board 33 in the up-down direction. Thus, the supporter 62 is in contact with the back board 33 at the three contact points, i.e., the support points P1, P3, P4. Further, like the front-side supporter 62, the rear-side supporter 63 has the tapered portions (not shown) and is held in contact with the back board 33 at three points. In the present embodiment, by attaching supporters 62, 63 in a state in which the tapered portions 75A, 78C, 79C thereof are in contact with the back board 33, the supporters 62, 63 can be easily positioned with respect to the soundboard braces 55C, 55D when attached thereto. Further, each of the supporters 62, 63 is held in contact with the inner surface 33A at the three points which are not located on one straight line. The three points define a plane, and a height H1 (FIG. 4) of each upper plate 62C, 63C from the back board 33 can be kept constant.

Advantage 8

The supporters 62, 63 are respectively fixed to the soundboard braces 55C, 55D such that each soundboard brace 55C, 55D is sandwiched by the corresponding supporter 62, 63. In this structure, the acoustic transducer device 61 can be later installed on the guitar 10 without a need of performing special work on the body 11 of the guitar 10 for installing the acoustic transducer device 61. Specifically, a user inserts the acoustic transducer device 61 through the sound hole 43, and the acoustic transducer device 61 can be installed on desired two soundboard braces 55A-55D.

It is to be understood that the present disclosure is not limited to the details of the illustrated embodiment, but may be modified and changed without departing from the scope of the present disclosure.

Figure 11:
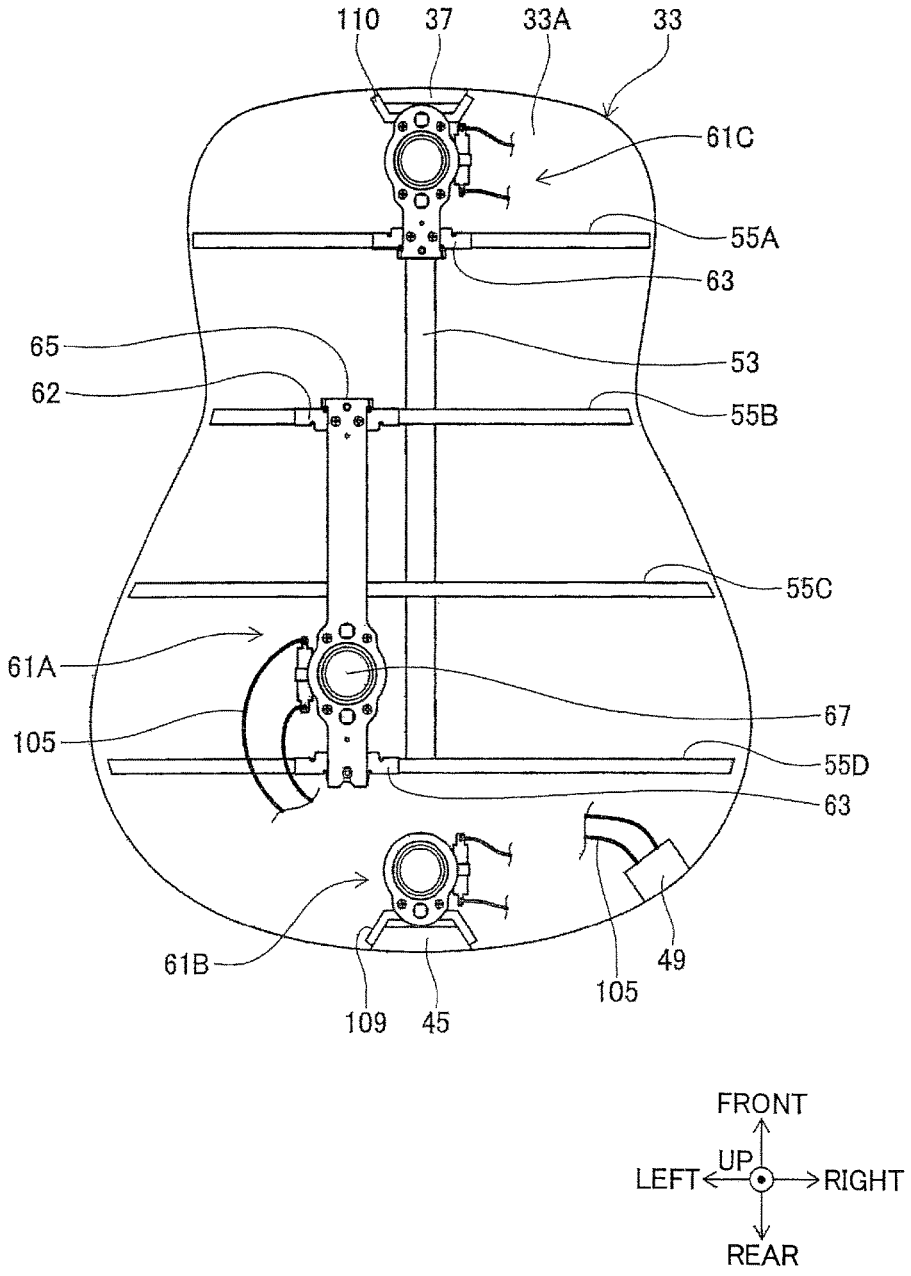
FIG. 11 is a plan view showing an inner side of a back board according to another example.

In the illustrated embodiment, the guitar 10 has only one acoustic transducer device 61. The guitar 10 may have a plurality of acoustic transducer devices 61. In the following explanation, the same reference numerals as used in the illustrated embodiment are used to identify the corresponding components, and detailed explanation thereof is dispensed with. FIG. 11 shows the inner surface 33A of the back board 33 according to another example. For instance, the guitar 10 may have three acoustic transducer devices 61A, 61B, 61C, as shown in FIG. 11. The three acoustic transducer devices 61A-61C are disposed at respective positions corresponding to antinodes of vibrations having mutually different frequencies, e.g., treble range, mid range, bass range, among vibrations generated in the back board 33. Thus, the acoustic transducer devices 61A-61C emit, from the respective back boards 33, sounds in accordance with the respective frequencies.

The position on which the acoustic transducer device 61 of the illustrated embodiment is installed may be changed. In the acoustic transducer device 61A shown in FIG. 11, the supporters 62, 63 are attached to respective soundboard braces 55B, 55D (as one example of two soundboard braces) which are adjacent to each other with the soundboard brace 55C interposed therebetween in the front-rear direction. Portions of the back board 33 to which the neck block 37 and the end block 45 are attached have increased rigidity, like the portions of the back board 33 to which the soundboard braces 55A-55D are attached. Consequently, there is a high possibility that the portions of the back board 33 to which the neck block 37 and the end block 45 are attached become nodes of the vibration. The acoustic transducer device 61B is attached to the end block 45. A supporter 109 holds the end block 45 from opposite sides of the end block 45 in the right-left direction, and the acoustic transducer device 61B is supported only by the end block 45.

Figure 14:
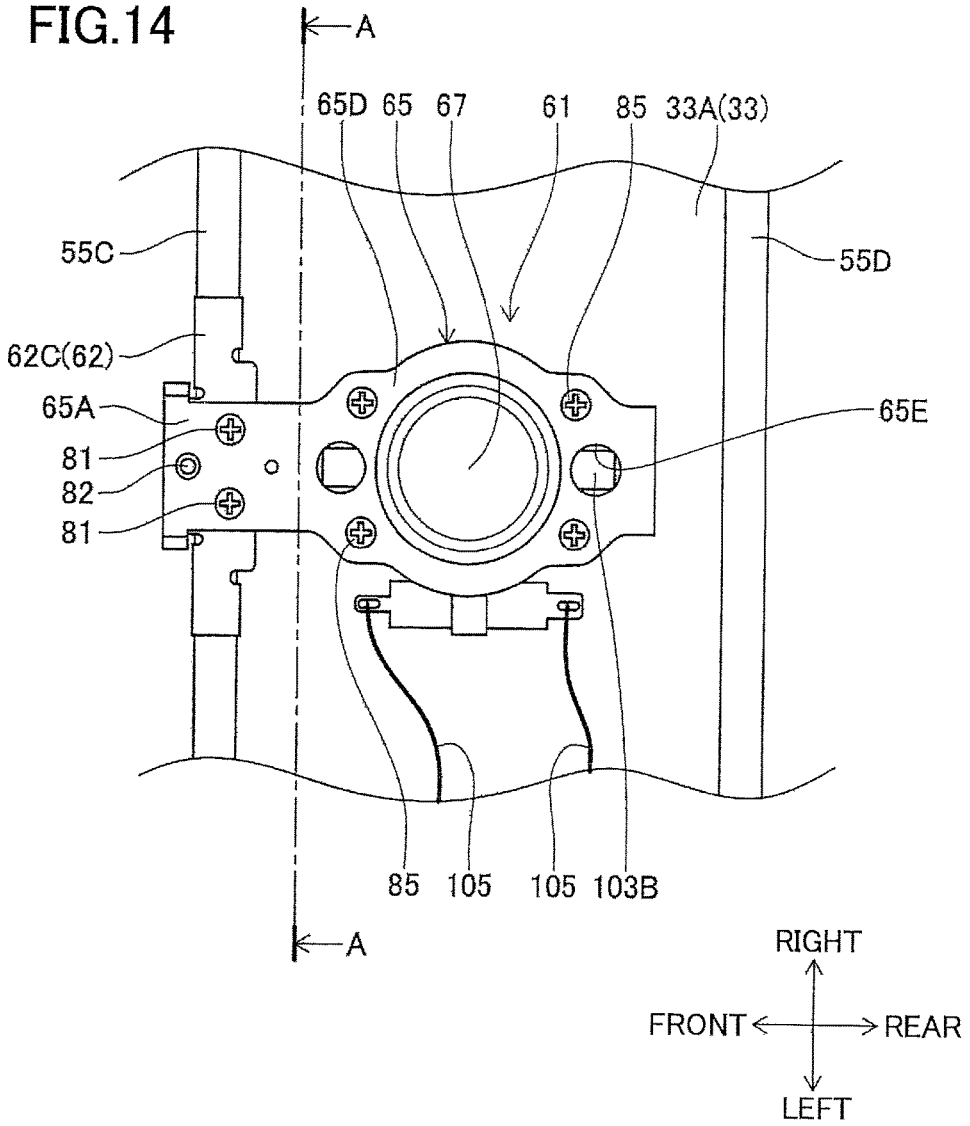
FIG. 14 is an enlarged view of a portion of the back board on which the acoustic transducer device is installed according to a modification.
Figure 15:
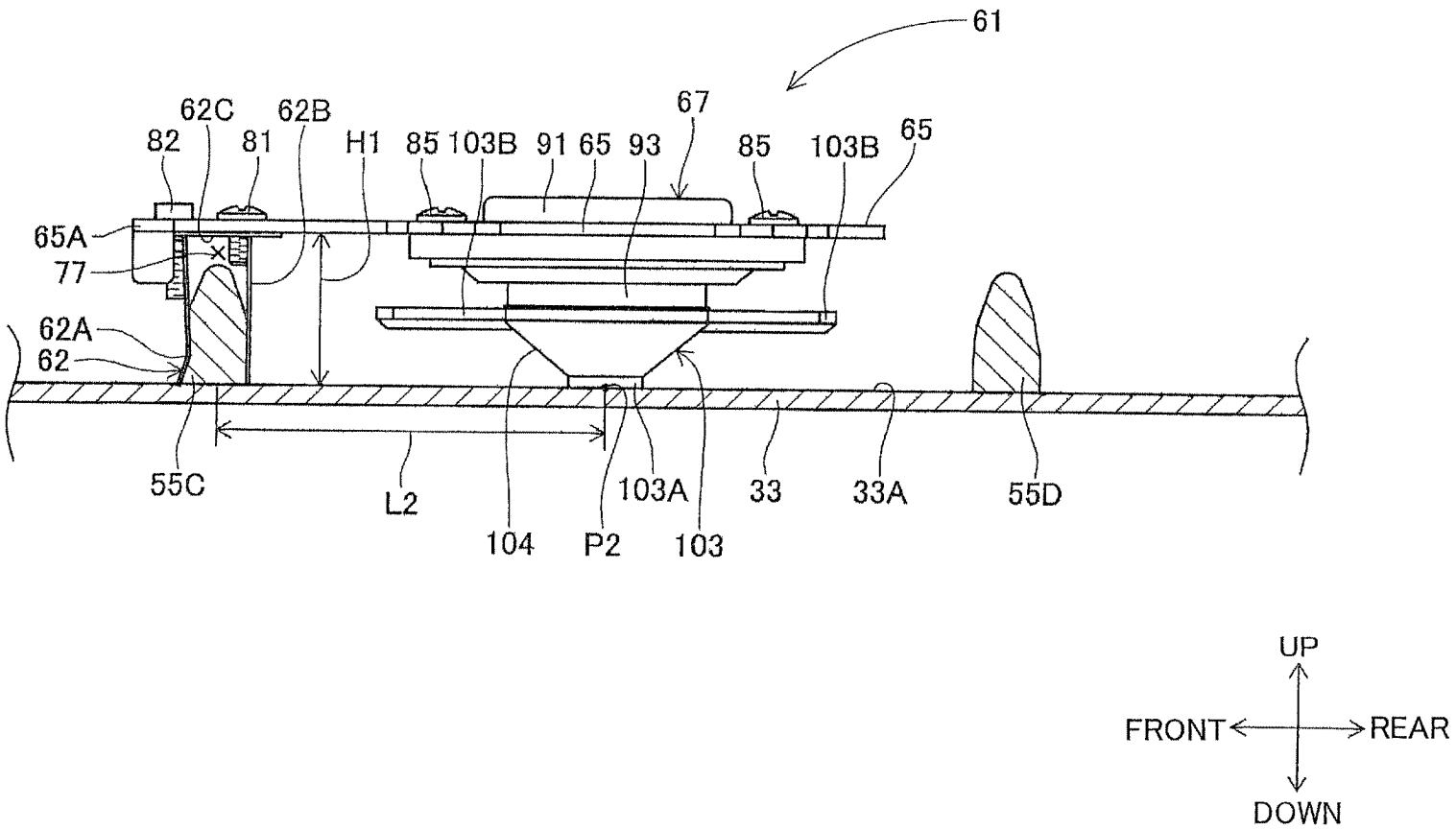
FIG. 15 is a side view of the acoustic transducer device of FIG. 14.

The acoustic transducer device 61C is attached to the neck block 37 and the soundboard brace 55A. The acoustic transducer device 61C is supported by a supporter 110 that holds the neck block 37 in the right-left direction and a supporter 63 that holds the soundboard brace 55A. Each of the neck block 37 and the end block 45 may have a protrusion or the like to each supporter 109, 110 is attached. The acoustic transducer device 61C may be installed as follows. For instance, the bracket 65 may be disposed between respective surfaces of the neck block 37 and the soundboard brace 55A opposed to each other in the front-rear direction, such that the bracket 65 functions as a tension rod, and the acoustic transducer 67 may be attached to the bracket 65. In this case, the supporter 63, 110 may be eliminated. The acoustic transducer device 61 may be attached to the separation preventive member 53, other than the soundboard braces 55A-55D. The acoustic transducer device 61 may be supported by the soundboard brace 55*c* via the front end portion 65A of the bracket 65, as shown in FIGS. 14 and 15. In this case, the bracket 65 is not supported by the soundboard brace 55*d* located on the back side of the bracket 65. That is, the acoustic transducer device 61 is supported in a cantilever manner with respect to the back board 33 (the acoustic portion).

The acoustic transducer devices 61A-61C installed on the guitar 10 may be in a state in which the acoustic transducer 67 of each device 61A-61C is removed from the bracket 65. In this case, the user may select any of the plurality of acoustic transducer devices 61A-61C which are installed in advance and may later attach the acoustic transducer(s) 67 to the selected acoustic transducer device(s). Thus, the user can selectively use the acoustic transducer devices 61A-61C that emit sounds preferred by the user.

Figure 12:
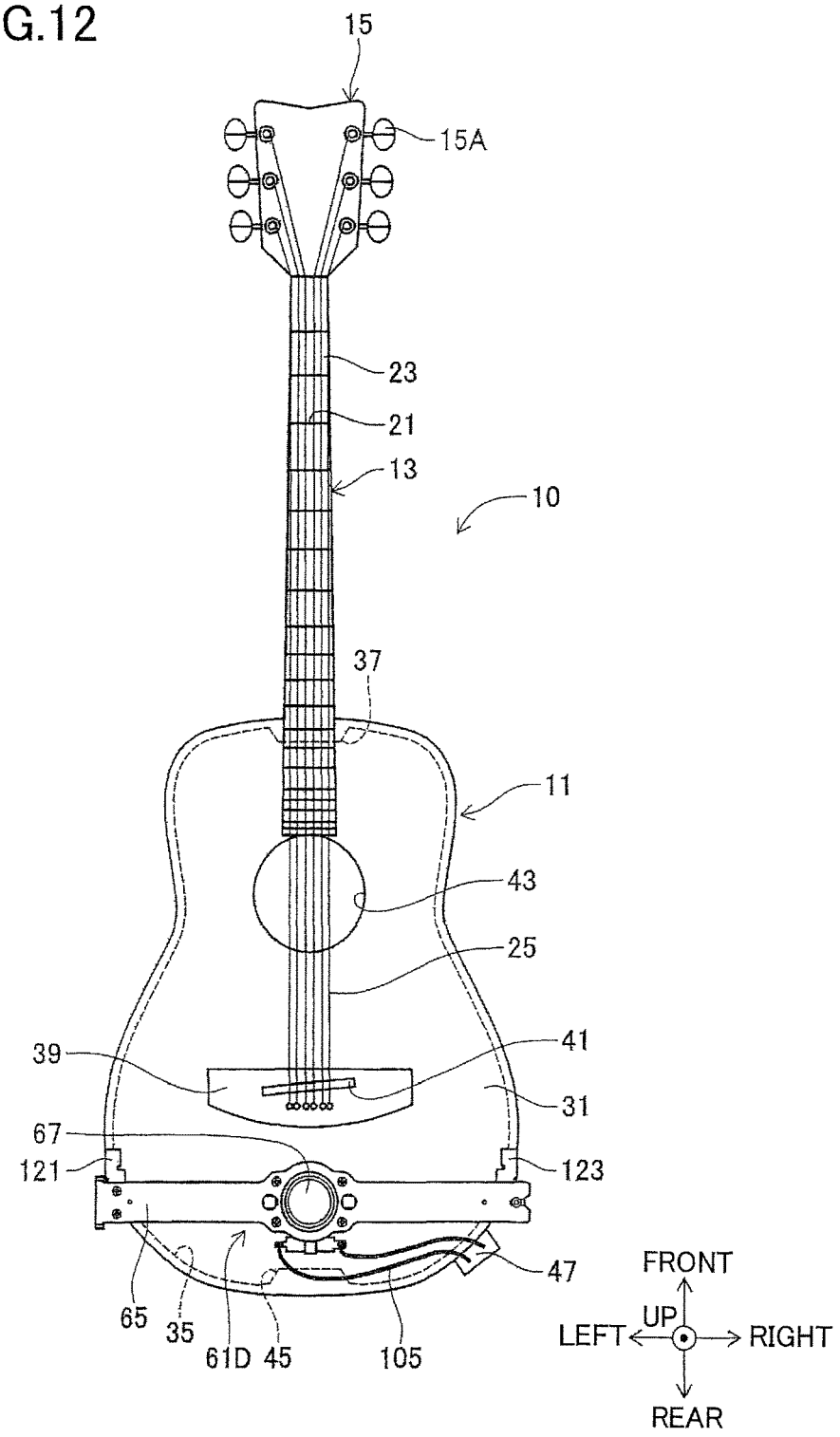
FIG. 12 is a plan view of a guitar according to still another example.

In the illustrated embodiment, the acoustic transducer device 61 is attached to the inside of the body 11. The acoustic transducer device 61 may be attached to the outside of the body 11. For instance, an acoustic transducer device 61D shown in FIG. 12 is attached to a front surface of the top board 31. The top board 31 has higher rigidity at its portion to which the side board 35 is attached, and there is a high possibility that the portion becomes the node of the vibration. The acoustic transducer device 61D includes supporters 121, 123 each of which is a plate bent in L-shape. The supporters 121, 123 are disposed outward of the side board 35 in the right-left direction and hold the body 11 from is opposite sides in the right-left direction, so that the acoustic transducer device 61D is fixed to the body 11. Also in this structure, the supporters 121, 123 are disposed at respective positions corresponding to the nodes of the vibration, and the acoustic transducer 67 is disposed at a position corresponding to the antinode of the vibration, as in the illustrated the embodiment.

Figure 13:
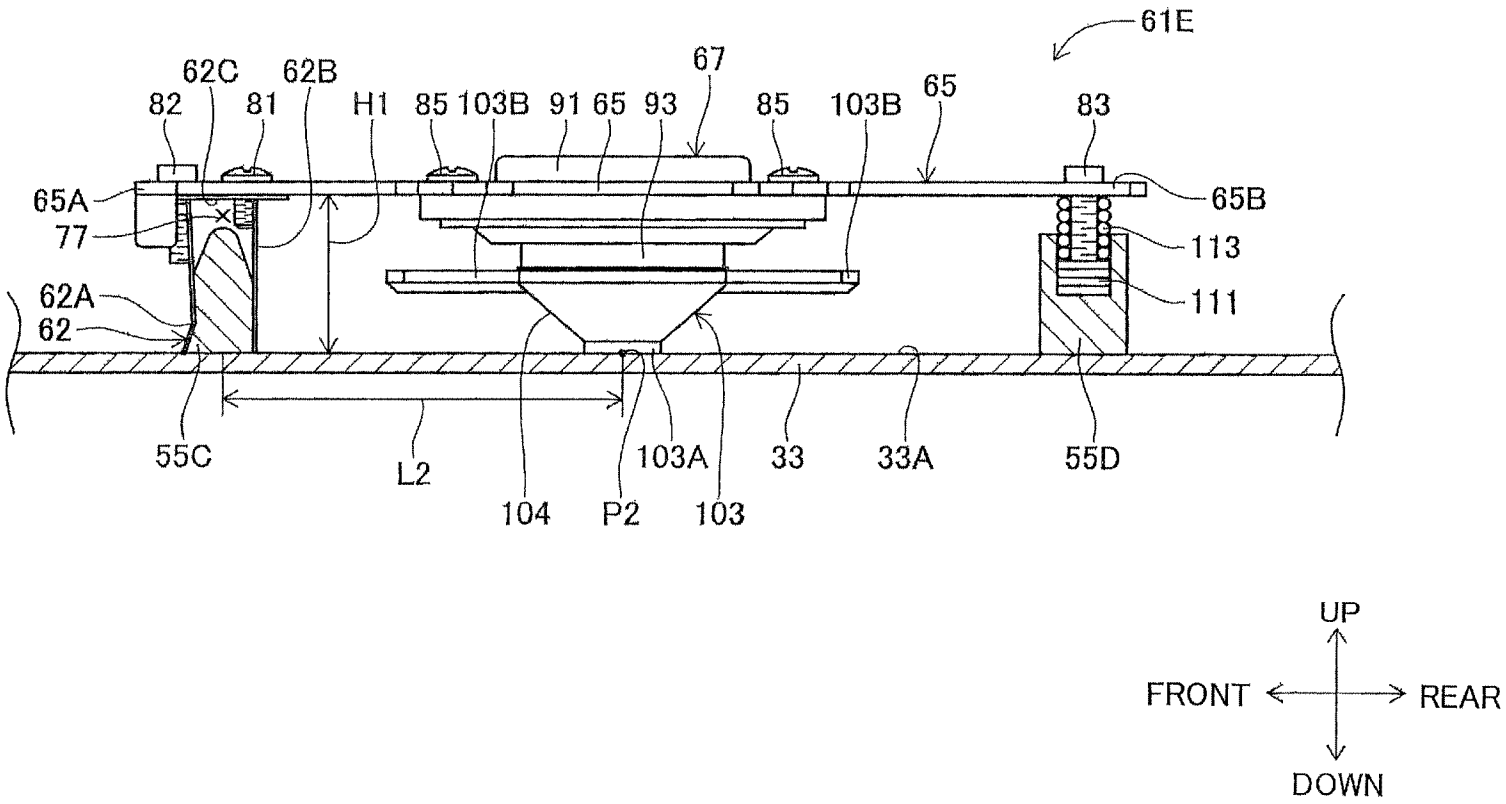
FIG. 13 is a side view of an acoustic transducer device according to a further example.

The supporters 62, 63 of the illustrated embodiment may be otherwise constructed. An acoustic transducer device 61E shown in FIG. 13 has a nut 111 embedded in the soundboard brace 55D. The nut 111 is an embedded nut such as ONIME insert nut®. The nut 111 is fixed in the soundboard brace 55D such that protrusions formed on is outer circumferential surface are held in engagement with the soundboard brace 55D. The hexagon socket head cap screw 83 is screwed in the nut 111. Further, a spring 113 is provided between the rear end portion 65B and the nut 111 in the up-down direction. The spring 113 is configured to be elastically deformed in the up-down direction. In the arrangement, the vibration of the back board 33 is partially absorbed by the spring 113 and is not directly transmitted from the soundboard brace 55D to the bracket 65. Consequently, the vibrating position P2 is prevented from being shifted due to the vibration. In the arrangement, the nut 111 is one example of a supporter.

The musical instrument to which the principle of the present disclosure is applied is not limited to the guitar 10 but may be other stringed musical instruments (e.g., violins), pianos, wind instruments, percussion instruments, and so on. For instance, the acoustic transducer device 61 of the illustrated embodiment may be attached to a soundboard rib provided on a soundboard of a piano, so as to vibrate the soundboard. Further, the acoustic transducer device 61 may be attached to a cross bar of a trumpet, so as to vibrate a bell. Moreover, the acoustic transducer device 61 may be attached to a shell of a membranophone such as a drum, so as to vibrate a membrane.

The guitar 10 may be an electric acoustic guitar. In this case, the guitar 10 may be configured such that a vibration of the strings 25 is converted into an electric signal by a pickup and the acoustic transducer device 61 is vibrated in accordance with the electric signal inputted thereto.

The materials and the shapes of the components in the illustrated embodiment may be otherwise changed. For instance, the supporters 62, 63 and the bracket 65 may be formed of plastic, other than metal. The bracket 65 may have a rib or ribs on its metal plate for increasing rigidity. The clearance 77 formed between the upper plate 62C and the soundboard brace 55C and between the upper plate 63C and the soundboard brace 55D may be eliminated.

What is claimed is:

1. A musical instrument, comprising:

an acoustic portion configured to generate sounds in accordance with a vibration;

a plurality of soundboard braces attached to a flat surface of the acoustic portion, each soundboard brace of the plurality of soundboard braces having an elongate shape such that a longer portion of each soundboard brace of the plurality of soundboard braces is parallel to the flat surface of the acoustic portion;

a bracket supported by two of the plurality of soundboard braces; and an acoustic transducer supported by the bracket and configured to vibrate the acoustic portion based on an acoustic signal inputted thereto, wherein the bracket is disposed so as to bridge the two of the plurality of soundboard braces, and the acoustic transducer vibrates the acoustic portion at a position between the two of the plurality of soundboard braces, and wherein the two of the plurality of soundboard braces and the acoustic transducer directly contact a surface of the acoustic portion at distinct contact points on the acoustic portion.

2. The musical instrument according to claim 1, wherein the two of the plurality of soundboard braces are adjacent two soundboard braces, and wherein the acoustic transducer vibrates the acoustic portion at a position middle between the adjacent two soundboard braces.

3. The musical instrument according to claim 1, wherein the acoustic transducer includes a vibrating portion configured to vibrate in accordance with the acoustic signal and a cap disposed between the vibrating portion and the acoustic portion and configured to vibrate with the vibrating portion so as to transmit the vibration to the acoustic portion, and wherein the cap includes a first tapered portion which is tapered in a direction from the vibrating portion toward the acoustic portion.

4. The musical instrument according to claim 3, wherein the cap includes a pressing portion through which a pressing force toward the acoustic portion is applied to the cap when the cap is fixed to the acoustic portion by bonding.

5. The musical instrument according to claim 1, further comprising a pair of supporters respectively attached to the two of the plurality of soundboard braces so as to support the bracket, wherein each of the supporters is held in contact with the acoustic portion at three or more support points which are not located on one straight line.

6. The musical instrument according to claim 5, wherein each of the supporters includes at least one second tapered portion which is tapered in a direction from the bracket toward the acoustic portion.

7. The musical instrument according to claim 5, wherein each of the supporters includes a first plate portion and a second plate portion between which a corresponding one of the two of the plurality of soundboard braces is sandwiched, and wherein the first plate portion and the second plate portion of each of the supporters are fixed to the corresponding one of the two of the plurality of soundboard braces by bonding.

8. An acoustic transducer device configured to vibrate an acoustic portion that generates sounds in accordance with a vibration, comprising:

a bracket supported by two of a plurality of soundboard braces, the plurality of soundboard braces being attached to a plane of the acoustic portion, each soundboard brace of the plurality of soundboard braces having an elongate shape such that a longer portion of each soundboard brace of the plurality of soundboard braces is parallel to the plane of the acoustic portion; and an acoustic transducer supported by the bracket and configured to vibrate the acoustic portion based on an acoustic signal inputted thereto, wherein the bracket is disposed so as to bridge the two of the plurality of soundboard braces, and the acoustic transducer vibrates the acoustic portion at a position between the two of the plurality of soundboard braces, and wherein the two of the plurality of soundboard braces and the acoustic transducer directly contact a surface of the acoustic portion at distinct contact points on the acoustic portion.

* * * * *